US005359762A

United States Patent [19]

Liu

[11] Patent Number: 5,359,762

[45] Date of Patent: Nov. 1, 1994

[54] DUAL-USAGE RIVETERS

[76] Inventor: Yang-Ting Liu, No. 76-1, 4 Lin, Shang-Guan Li, Yuan-Li, Miao-Li Hsien, Taiwan, Province of China

[21] Appl. No.: 135,397

[22] Filed: Oct. 13, 1993

[51] Int. Cl.[5] ..... B21J 15/04

[52] U.S. Cl. ..... 29/243.527; 29/243.521; 72/391.4

[58] Field of Search ..... 29/243.521, 243.522, 29/243.523, 243.524, 243.525, 243.526, 243.527, 243.528, 243.529; 72/391.2, 391.4, 391.6

[56] References Cited

U.S. PATENT DOCUMENTS

| | | | |
|---|---|---|---|
| 3,760,627 | 9/1973 | Richardson et al. | 29/243.523 |
| 4,598,572 | 7/1986 | Mondello et al. | 29/243.522 |
| 5,050,420 | 9/1991 | Liu | 29/243.521 X |
| 5,079,818 | 1/1992 | Schwab | 29/243.526 X |

FOREIGN PATENT DOCUMENTS

| | | | |
|---|---|---|---|
| 128875 | 12/1984 | European Pat. Off. | 29/243.521 |
| 690103 | 4/1953 | United Kingdom | 29/243.527 |
| 723011 | 2/1955 | United Kingdom | 29/243.527 |

*Primary Examiner*—Rinaldi I. Rada
*Attorney, Agent, or Firm*—Morton J. Rosenberg; David I. Klein

[57] ABSTRACT

A dual-usage riveter including two handles pivoted to a base member is provided. A pull shaft linked between the handles is axially displaced thereby. An outer sleeve is fastened to the front end of the base member to hold an inner sleeve. Two symmetrical clamping plates, a stop member, a spring, and a plug are respectively inserted into the inner sleeve and moved by the pull shaft to set rivets. A connecting shaft may be alternatively inserted in the base member and connected to the pull shaft to drive a pull rod for setting rivnuts.

1 Claim, 4 Drawing Sheets

DUAL-USAGE RIVETERS

BACKGROUND OF THE INVENTION

The present invention relates to riveters, and more specifically relates to a dual-usage riveter which is suitable for setting rivets as well as rivnuts.

A variety of riveters have been disclosed, and have appeared on the market. These riveters are designed for a specific purposes, and therefore different riveters must be used for setting rivets and rivnuts.

SUMMARY OF THE INVENTION

The present invention eliminates the aforesaid disadvantage. It is therefore the principal object of the present invention to provide a dual-usage riveter which is practical for setting rivets as well as rivnuts. It is another object of the present invention to provide a transmission mechanism for the dual-usage riveter which consists of links and rollers, and which smoothens the operation of the riveter. According to the present invention, the dual-usage riveter comprises two handles pivoted to a base member, a pull shaft linked between the handles by links and rollers, an outer sleeve fastened to the front end of the base member to hold and inner sleeve, wherein two symmetrical clamping plates, a stop member, a spring, and a plug are respectively inserted into the inner sleeve and moved by the pull shaft to set rivets; a connecting shaft is alternatively inserted in the base member and connected to the pull shaft to drive a pull rod for setting rivnuts.

BRIEF DESCRIPTION OF THE DRAWINGS

FIG. 1-1 is a sectional view showing a rivet deformed by the dual-usage riveter of FIG. 1 to fasten two workpieces together;

FIG. 2-1 is a sectional view showing a rivnut deformed by the dual-usage riveter of FIG. 2 to fasten two workpieces together.

DETAILED DESCRIPTION OF THE PREFERRED EMBODIMENT

Figure 1:
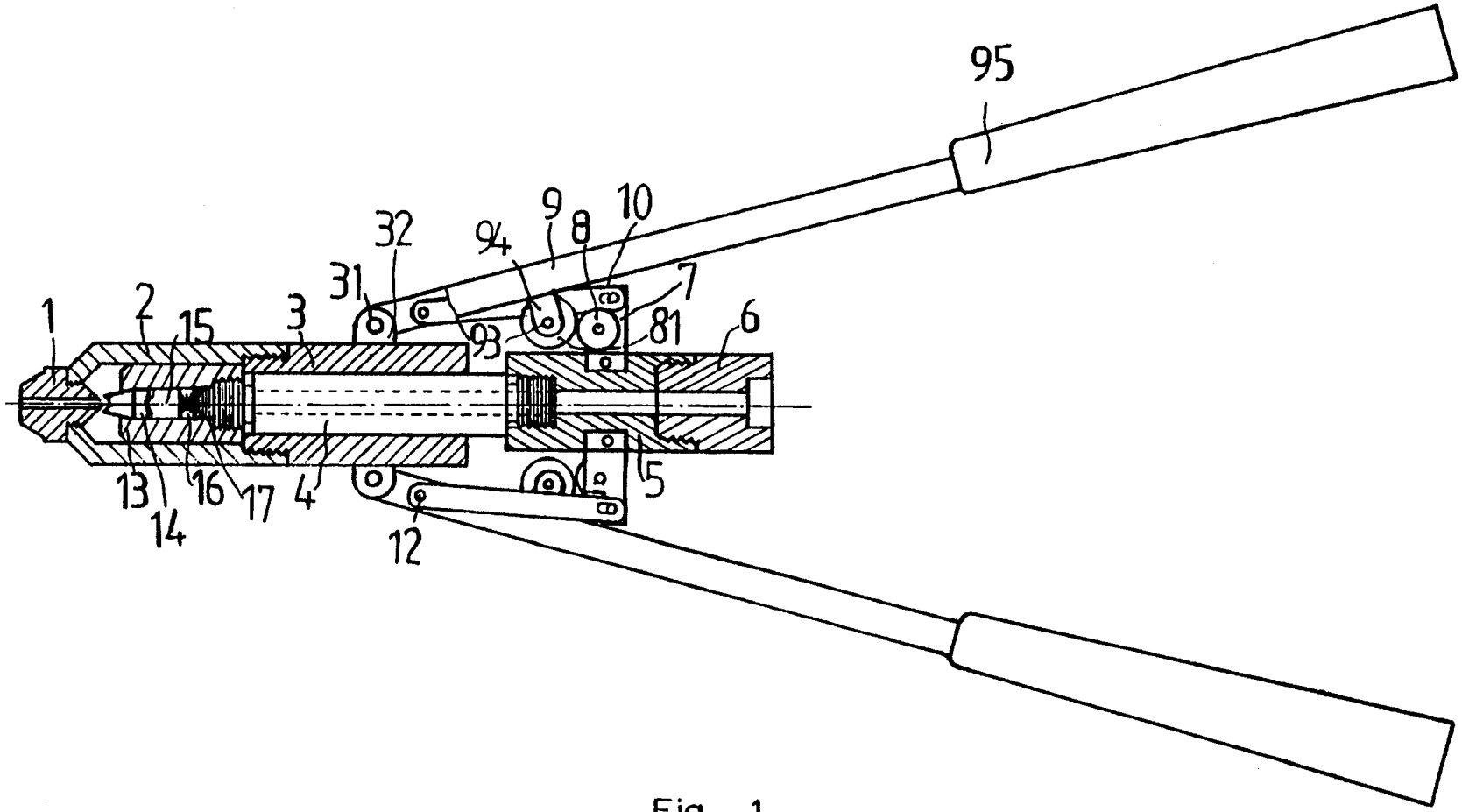
FIG. 1 is a plan view of a dual-usage riveter according to the preferred embodiment of the present invention.
Figures 1, 2:
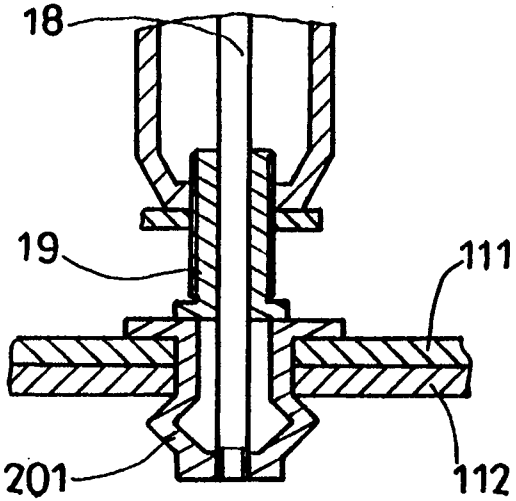
FIG. 2 is a plain view of the dual-usage riveter of FIG. 1 arranged for setting a rivnut.
Figure 1:
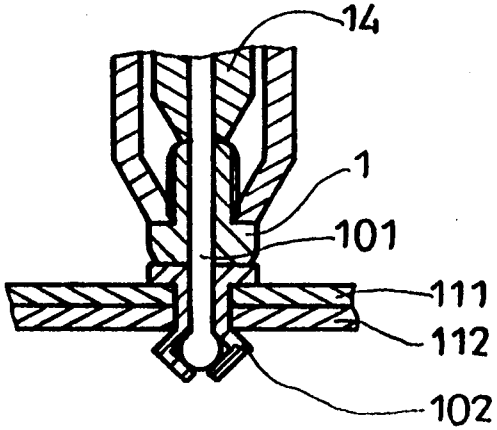
Figure 2:
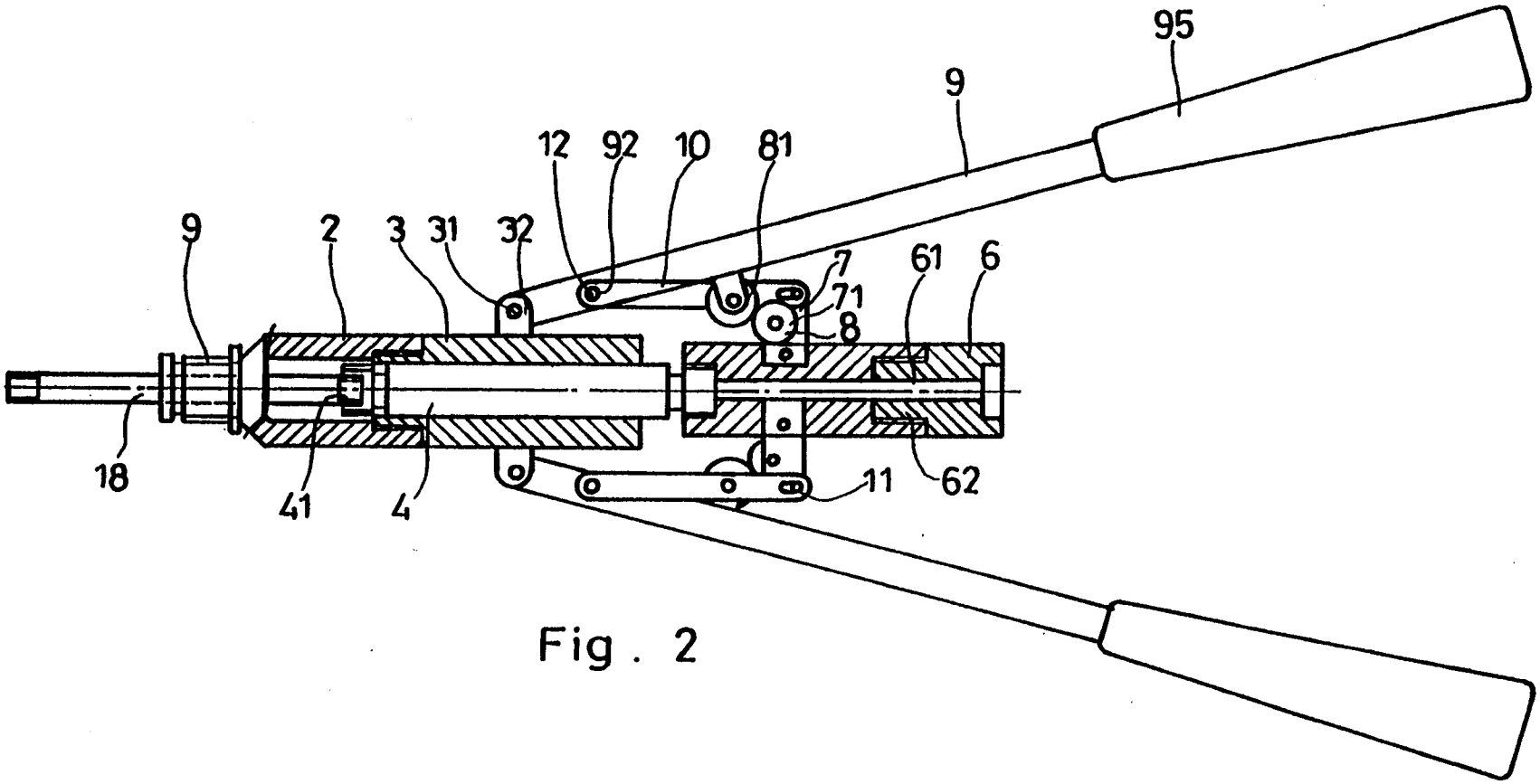
Figure 3:
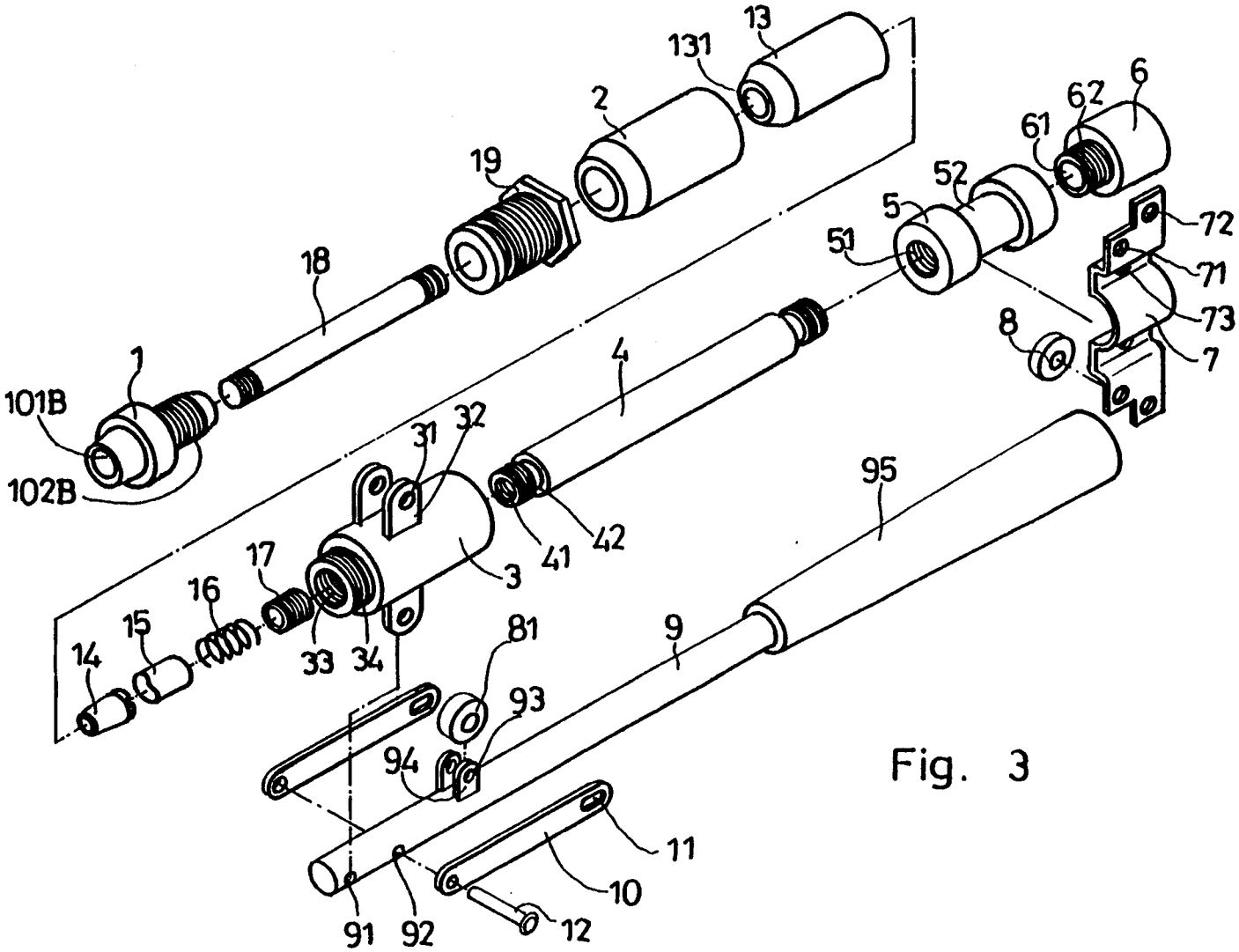
FIG. 3 is an exploded view of the dual-usage riveter of FIGS. 1 and 2.

Referring to FIGS. 1, 2, and 3, the base member 3, of the riveter of the preferred embodiment of the present invention comprises a center through hole 33 through its length, an outer thread 34 on one end thereof, and two opposite pairs of lugs 32 with respective pin holes 31 bilaterally disposed on its outside surfaces. There are provided two handles 9 each pivotably connected to a respective one of each pairs of lugs 32 of the base member 3. Each handle 9 comprises a first pin hole 91 on a front end thereof connected between the pin holes 32 of a respective one of the pairs of lugs 32 by a pivot pin (not shown), a hand grip 95 is disposed on an opposite end therewith. A pair of lugs 94 with respective axle holes 93 are located near the first pin hole 91. A first roller 81 is mounted between the lugs 94 by a wheel axle (not shown), which inserts through the axle holes 93 on the lugs 94. There is provided a pull shaft 5 having a neck potion 52 in the middle and a threaded hole formed through the longitudinal axis thereof. A connector 6 and a connecting axle 4 are respectively connected to the two opposite ends of the pull shaft 5. The connector 5 comprises a longitudinal through hole 61 through its longitudinal axis, and an outer thread 62 on one end. The connector 6 is threaded into the screw hole 51 of the pull shaft 5, at one end thereof. The connecting shaft 4 is inserted into the center through hole 33 of the base member 3, having a threaded rear end threaded into the screw hole 51 on the pull shaft 5 at an opposite end. There are two pull shaft holder frames 7 connected between the handles 9 by links 10 to hold the pull shaft 5. The pull shaft holder frames 7 are mounted around the neck portion 52 of the pull shaft 5 by threading screw bolts (not shown) into respective screw holes 73 thereof. The frames 7 have respective axle holes 71 through which are inserted respective wheel axles (not shown) to hold second rollers 8. Each second roller 8 is respectively disposed in contact with the first roller 81 on a respective handle 9. Each frame 7 has a respective pin hole 72 connected to a respective hole 11 formed on one end of a respective link 10 by a pin (not shown). The opposite end of the link 10 is pivotally coupled to a pin hole 92 on a respective handle 9 by a respective pivot pin 12. There is provided an outer sleeve 2 having an inner thread (not shown) on one end for threaded coupling with the outer thread 34 of the base member 3.

Different members are mounted within the sleeve 2 according to the purpose of the riveter for setting rivets or rivnuts. When the riveter is to be used for setting a rivet, as shown in FIGS. 1, 1-1, and 3, an inner sleeve 13 which has a tapered front end 131 made gradually smaller toward the front is inserted into the outer sleeve 2. Before connecting the outer sleeve 2 to the base member 3, two symmetrical clamping plates 14 are inserted into the inner sleeve 13, then a stop member 15 and a spring 16 and a plug 17 are respectively inserted into the inner sleeve 13, and then the inner sleeve 13 with the contained members are inserted into the outer sleeve 2, and then a hollow guide screw member 1 is fastened to the outer sleeve 2 through a screw joint. The inner sleeve 13 is threadedly coupled to the threaded end portion 42 of the connecting shaft 4.

Referring to FIGS. 1, 1-1, and 3 again, pulling the handles 9 apart causes the pull shaft holder frames 7 to move the pull shaft 5 forwards. At the same time, the clamping plates 14 are moved to the hollow guide screw member 1 and caused by it to separate from each other, and therefore the rivet rod 101 is inserted through the hollow guide screw member 1. As the handles 9 are moved toward each other, the connecting shaft 4 is driven to pull the rivet rod 101 backwards, causing the rivet tube 102 deformed in fastening two opposite workpieces 111;112 together. When set, the rivet rod 101 is pulled broken, and therefore the two opposite workpieces 111;112 are fastened together.

When the riveter is to be used for setting a rivnut, as shown in FIGS. 2, 2-1, and 3, the outer sleeve 2 is threaded onto the outer thread 34 of the base member 3, then a pull rod 18 is inserted through the outer sleeve 2 and longitudinally fastened to the connecting shaft 4 through its internally threaded opening 41, and then a stop member 19 is mounted around the pull rod 18 and fastened to the outer sleeve 2 on the outside.

Referring to FIGS. 2, 2-1, and 3 again, the handles 9 are pulled apart to extend the pull rod 18 out of the outer sleeve 2 and the stop member 19. The rivnut 201 is then threaded onto the pull rod 18 and then inserted through the workpieces 111;112 to be fastened. Then, the handles 9 are moved toward each other to move the pull shaft holder frames 7 backwards, causing the pull rod 18 to move backwards, and therefore the rivnut 201 is squeezed to deform.

What is claimed is:

1. A dual-usage riveter comprising:

a base member having a centrally located through bore extending longitudinally therethrough and an external thread formed on one end thereof, said base member having two pairs of lugs extending from an external surface of said base member, each of said pairs of lugs being disposed on opposing sides of said base member;

two handles, each of said handles having a respective front end pivotally coupled to a respective one of said pairs of lugs;

two symmetrical holder frames connected between said handles by links;

a pair of first rollers respectively mounted on said handles;

a pair of second rollers respectively mounted on said holder frames and disposed in contact with said pair of first rollers;

a pull shaft retained between said holder frames, said pull shaft being moved forwards as said handles are closed and backwards as said handles are opened;

an outer sleeve having an inner thread formed on one end thereof for threaded coupling with the external thread of said base member, said outer sleeve having a longitudinal bore formed therethrough;

connecting shaft disposed within said through bore of said base member and connected to said pull shaft on a first end there; and, means for applying a tensile force to a rivet type fastener coupled to a second end of said connecting shaft, said force applying means being selected from (1) means for displacing a rivet rod of a rivet type fastener, or (2) means for displacing means including (1) a hollow guide screw member coupled to a distal end of said outer sleeve, (2) an inner sleeve coupled to said second end of said connecting shaft and disposed within said bore of said outer sleeve, (3) a tapered clamping member disposed within a longitudinal bore formed through said inner sleeve and formed of two symmetrical clamping plates, (4) a plug member disposed within said longitudinal bore of said inner sleeve adjacent said connecting shaft, and (5) a first stop member and spring disposed within said longitudinal bore of said inner sleeve between said tapered clamping member and said plug member, said means for displacing a portion of a rivnut type fastener including (1) a second stop member coupled to said distal end of said outer sleeve, said second stop member having a longitudinal through bore formed therein, and in axial alignment with said longitudinal bore of said outer sleeve, and (2) a pull rod coupled to said second end of said connecting shaft and passing through said axially aligned bores of said outer sleeve and said second stop member.

* * * * *